US005619244A

United States Patent [19]

Manna

[11] Patent Number: 5,619,244

[45] Date of Patent: Apr. 8, 1997

[54] THERMAL INK CASSETTE FOR A THERMAL PRINTING DEVICE

[75] Inventor: Robert E. Manna, Newtown, Conn.

[73] Assignee: Pitney Bowes Inc., Stamford, Conn.

[21] Appl. No.: 363,781

[22] Filed: Dec. 27, 1994

[51] Int. Cl.[6] ..... B41J 31/00; B41J 33/14

[52] U.S. Cl. ..... 347/214; 400/234

[58] Field of Search ..... 347/214; 400/207, 400/208, 208.1, 234, 236; 242/331.5, 338.5

[56] References Cited

U.S. PATENT DOCUMENTS

| | | | |
|---|---|---|---|
| 4,676,678 | 6/1987 | Watanabe | 400/234 |
| 4,908,632 | 3/1990 | Ishikawa et al. | 400/234 |
| 5,192,149 | 3/1993 | Gillio | 400/234 |

OTHER PUBLICATIONS

Grafstein, Paul, et al., *Pictorial Handbook*, N.Y., Chemical Publishing Co., Inc, 1971. pp. 58–75.

*Primary Examiner*—Benjamin R. Fuller
*Assistant Examiner*—L. Anderson
*Attorney, Agent, or Firm*—Robert E. Meyer; Melvin J. Scolnick

[57] ABSTRACT

The thermal ribbon cassette is attachable to a thermal printing apparatus, the cassette housing is formed by a forward section attached to a rear wall to define a chamber. A supply spool is rotatively mounted to the forward section and the rear wall in the chamber. The supply spool has an ink transfer ribbon continuously wrapped there around and a number of interrupters continuously formed around the edge of the spool. A drag spring is mounted to the rear wall and biased against the interrupters for providing a rotational drag force. The take-up spool is rotatively mounted to the forward section and the rear wall in the chamber, the ink transfer ribbon has one end fixably mounted to the take-up spool and a portion extending through slots in the housing such that a portion of the ink transfer ribbon extends externally to said chamber. A locking gear arrangement is provided for preventing rotation of the take-up spool except in a forward direction.

3 Claims, 3 Drawing Sheets

THERMAL INK CASSETTE FOR A THERMAL PRINTING DEVICE

BACKGROUND OF THE INVENTION

The present invention relates to thermal printing devices and, more particularly, to thermal printing digital postage meters and thermal ink cassettes therefor.

U.S. Pat. No. 5,300,953, entitled THERMAL RIBBON CASSETTE TENSION CONTROL FOR A THERMAL POSTAGE METER describes a thermal printing cassette particularly suited for application with a digital thermal printing postage meter system. In empirical evaluation of the thermal printing cassette described in U.S. Pat. No. 5,300,953, it has been determined that thermal transfer ribbon cassettes exhibited non-linear torque requirements for the cassette drive system as described in U.S. Pat. No. 5,300,953 over the change in radius of the cassette supply spool which was considered disadvantageous.

SUMMARY OF THE INVENTION

It is an objective of the present invention to present an improved thermal transfer ribbon having a simpler construction and which approximates a more linear torque response over the radius of the supply spool.

The thermal ribbon cassette is comprised of a housing having a formed forward section and a formed rear wall section to define a chamber. The interior of the back wall includes formed hub for rotatably supporting a supply spool and a take-up spool. Formed on the interior wall of the backing wall is a locking hub which has positioned therearound is a locking gear such that the locking gear can rotate around the locking hubs and transversely float relative to the locking hub. Also, formed on the internal of the rear wall iS a locking pin positioned to either engage a locking pin or disengage the lock pin. The take-up spool includes a gear which is engaged with the locking gear such that when the spool is rotated in the forward direction, the locking gear is disengaged from the locking pin. However, if the take-up spool is rotated in the opposing or reverse direction, the locking gear is brought into contact with the locking pin, thereby, preventing the take-up spool from rotating in the reverse direction.

Formed on the internal surface of the backing wall are two support posts for securing a drag leaf spring in the area of the supply spool for engaging a continuous series of interrupters formed on the supply spool to provide a constant drag to the supply spool. Also secured between two other support posts is a locking leaf spring which is located to intrude between two adjacent interrupters to prevent rotation of the supply spool. Aligned to the locking spring is an aperture which when the cassette is placed in position on a printing apparatus will receive a release pin to deflect the locking spring away from the interrupters allowing the supply spool to rotate.

DETAILED DESCRIPTION OF THE PREFERRED EMBODIMENT

Figure 1:
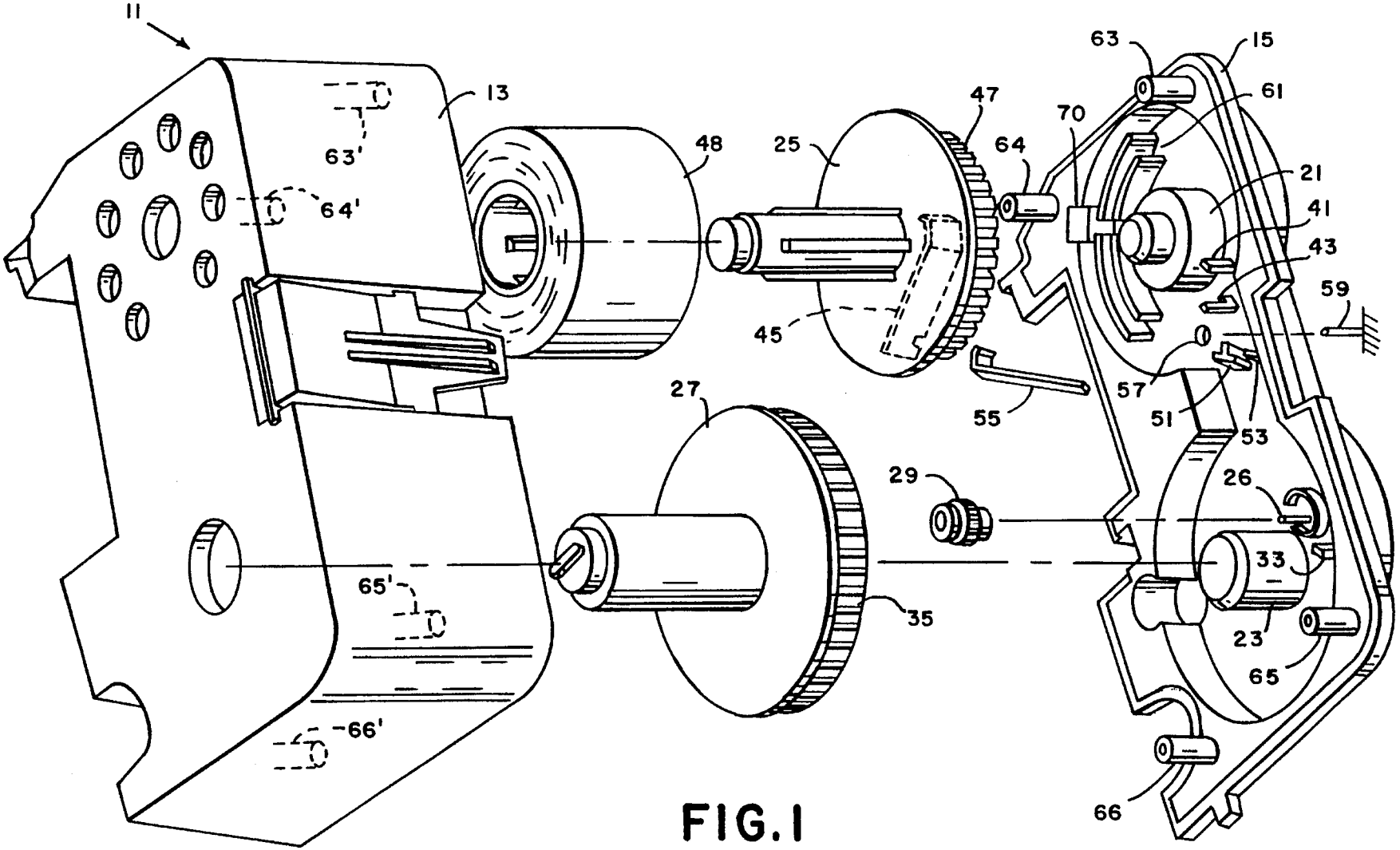
FIG. 1 is an exploited view of a thermal ribbon cassette in accordance with the present invention.
Figure 2:
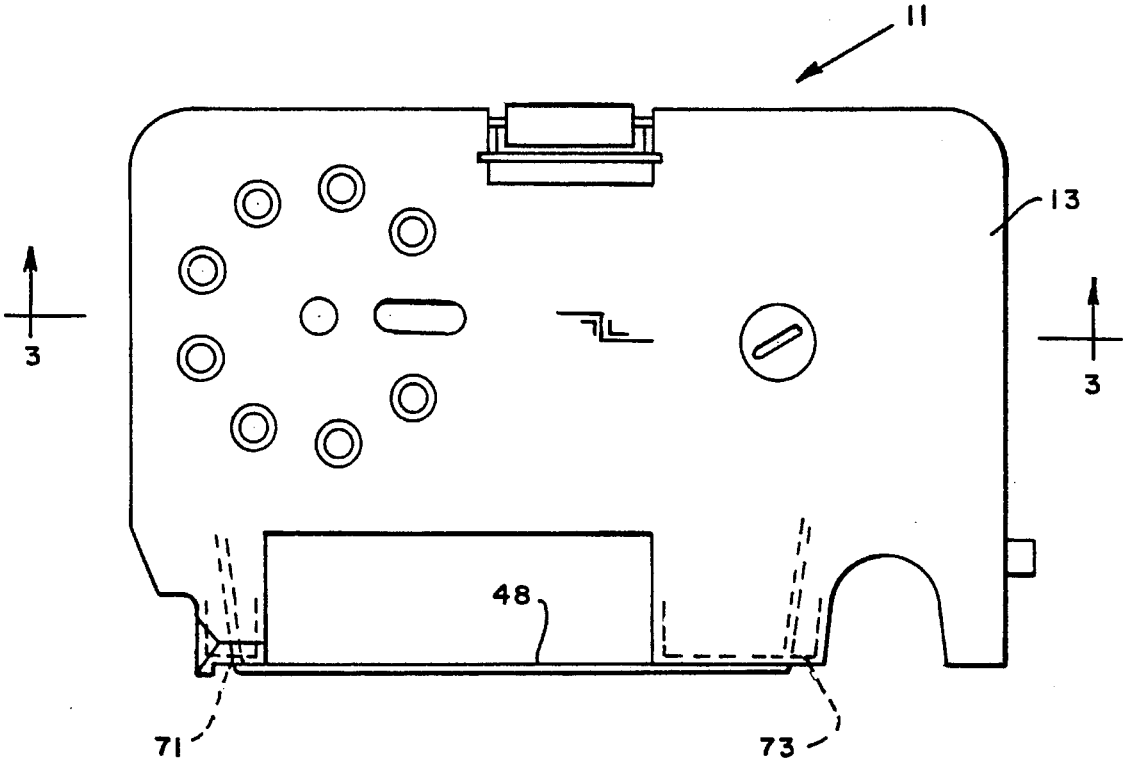
FIG. 2 is a front view of the thermal ribbon cassette in accordance with the present invention.
Figure 3:
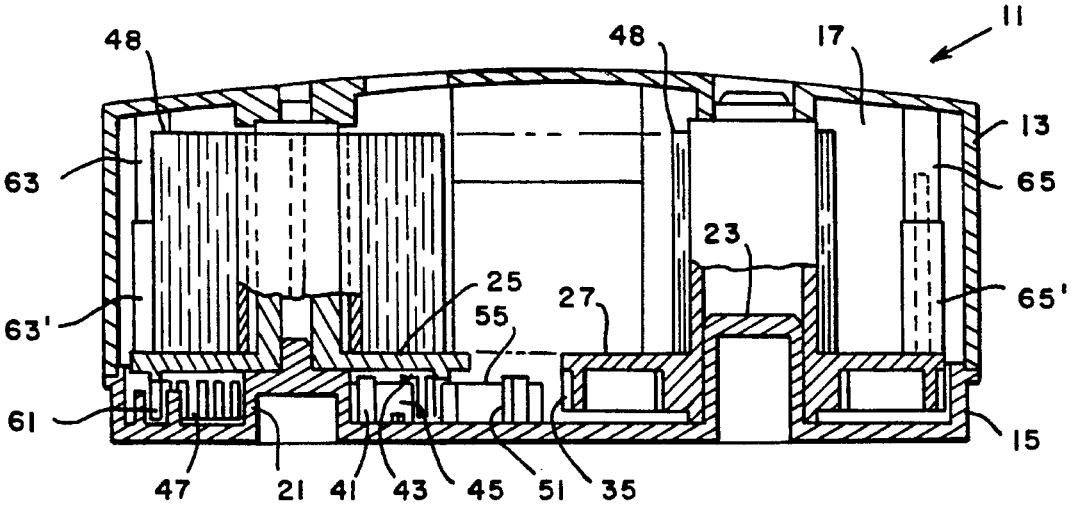
FIG. 3 is a sectional view of the thermal ribbon cassette along line 3—3 in accordance with the present invention.
Figure 4:
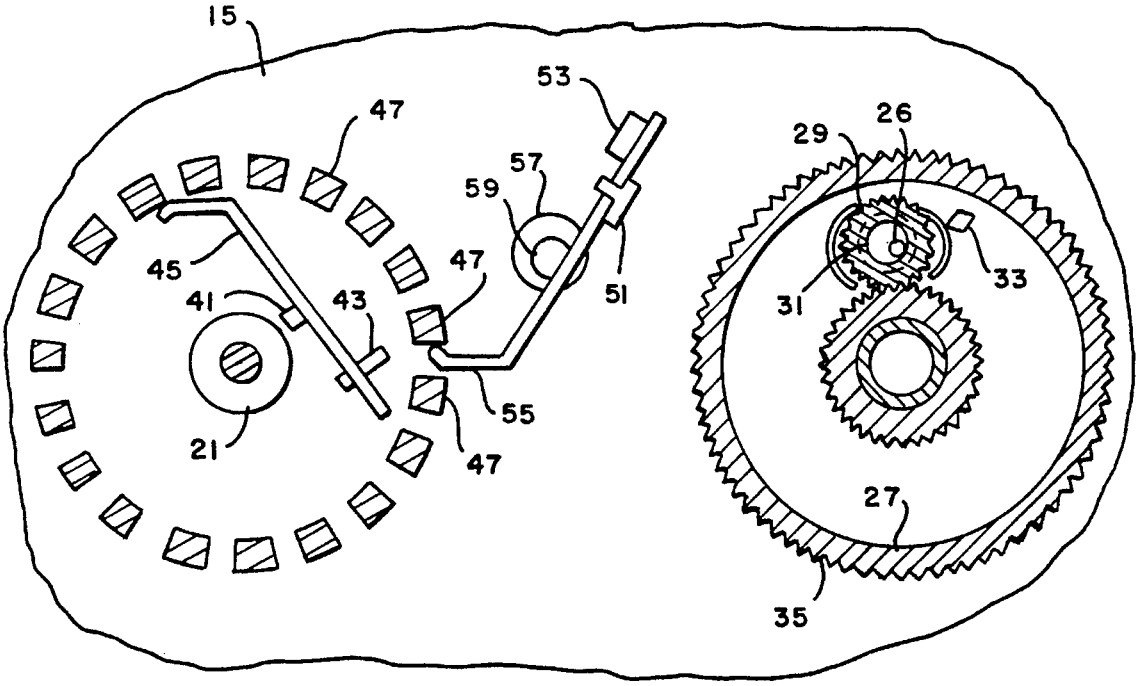
FIG. 4 is a frontal view of thermal ribbon cassette drag and locking mechanism and a sectional view of the supply and take-up spools in accordance with the present invention.

Referring to the figures, the thermal ribbon cassette, generally indicated as a 11, is comprised of a housing having a formed forward section 13 and a formed rear wall section 15 which define a chamber 17. The interior of the rear wall section 15 includes formed hub 21 and 23 for rotatably supporting a supply spool 25 and a take-up spool 27, respectively. Formed on the interior wall of the rear wall section 15 is a hub 26 which has positioned therearound a locking gear 29. The locking gear 29 is positioned around the hub 26 to receive the hub 26 within an oversized aperture 31. As a result, the locking gear 29 can rotate around the hub 26 and transversely float relative to the hub 26. The motion of the locking gear 29 causes the locking gear 29 to be positioned in a first position which engages the locking pin 33 or a second position which disengages the locking pin 33 from a formed locking pin 33.

The take-up spool 27 includes a gear 35 which is in continuous engagement with the locking gear 29 such that when the spool 27 is rotated in the forward,direction, the locking gear 29 is caused by gear 35 to transversely displace disengaged from the locking pin 33. However, if the take-up spool 27 is rotated in the reverse direction, the locking gear 29 is brought into engaging contact with the locking pin 33 which, because of engagement between gears 29 and 35, prevents the take-up spool 27 from rotating in the reverse direction.

Formed on the internal surface of the backing wall are two securing posts 41 and 43 for securing a drag leaf spring 45 in the area of the hub 21. The drag leaf spring 45 is positioned between the post 41 and 43 such that one end of the drag leaf spring 45 is biased to engage interrupters 47 which is continuously formed around the base of the supply spool 25. The communication between the interrupters 47 and the leaf spring 45 provide a constant drag to the supply spool 25. The drag force prevents the unraveling of the thermal transfer tape 48 secured around the supply spool 25 by any suitable means. Also secured between two other formed securing posts 51 and 53 is a locking spring 55. The locking leaf spring 55 is secured between the posts 51 and 53 in such a way as to cause one end of the locking leaf spring 55 to intrude between the two adjacent interrupters 47, thereby preventing rotation of the supply spool 25. Aligned to the locking leaf spring 55 is an aperture 57 which when the cassette is placed in position will receive a release pin 59 which will deflect the locking leaf spring 55 away from and out from between the interrupters 47.

When assembled, the cassette 11, the thermal transfer ribbon 48 is secured around the supply spool 25 utilizing any suitable conventional method, and the outer end of the ribbon 48 is secured to the take-up spool 27 by any suitable conventional method. The leaf springs 45 and 55 are then positioned between respective posts 41, 43 and 51,53. The supply spool 25 is then positioned on the hub 21 such that the interrupters 47 traverse through a formed channel 61, and the drag spring 45 and locking springs are positioned relative to the interrupters 47 as described.

The gear 29 and the gear 35 are located to be in constant mesh with each other. The forward section 13 and a formed rear wall section 15 are then secured together by any suitable means such as by screws threadably extending through posts 63–63', 64–64', 65–65' and 66–66' locating the spools 25 and 27 in the defined chamber 17. The thermal ribbon 48 is positioned such that a portion of the thermal ribbon 48 extends through slots 71 and 73 to enable a portion of the thermal ribbon to be outward of the cassette. The rear wall section 15 includes an aperture 70 formed therein to allow the introduction of a sensor (not shown).

The afore description is of the preferred embodiment of the present invention and should not be viewed as limiting. The scope of the invention is defined by the appendix claims.

What is claimed is:

1. An improved thermal ribbon cassette for attachment to a thermal printing apparatus having a housing formed by a forward section attached to a rear wall to define a chamber, wherein the improvement comprises:

a supply spool rotatably mounted to said forward section and said rear wall and located in said chamber, said supply spool having an ink transfer ribbon continuously wrapped therearound and a plurality of interrupters continuously formed therearound;

a drag spring mounted to said rear wall and biased against said interrupters for providing a rotational drag force on said supply spool;

a take-up spool rotatably mounted to said forward section and said rear wall located in said chamber;

said ink transfer ribbon having one end fixedly mounted to said take-up spool and having a portion extending through slots in said housing such that a portion of said ink transfer ribbon extends external to said chamber; and means for preventing rotation of said take-up spool except in a forward direction, said rotation preventing means comprising said rear wall having a locking pin in said chamber, a first gear rotatably and transversely mounted in said chamber, said take-up spool having a second gear formed thereon in constant mesh with said first gear such that rotation of said take-up spool in the forward direction causes said first gear to transversely displace away from said locking pin and such that rotation of said take-up spool in a reverse direction causes said first gear to engage said locking pin.

2. An improved thermal ribbon cassette as claimed in claim 1 wherein said improvement further comprises locking means for preventing rotation of said supply spool unless said thermal ribbon cassette is attached to said printing apparatus.

3. An improved thermal ribbon cassette as claimed in claim 2 wherein said locking means comprises a leaf spring fixably mounted at a point along its length such that one end of said leaf spring is interposed between adjacent interrupters, said rear wall having an aperture located in the proximity of said leaf spring such that a release pin formed on said printing apparatus when projected in said aperture causes said leaf spring to deflect causing said end of said leaf spring to displace away from said interrupters of said supply spool.

* * * * *